United States Patent [19]

Suzuki et al.

[11] Patent Number: 5,001,998

[45] Date of Patent: Mar. 26, 1991

[54] PATTERN MATCHING SEWING MACHINE

[75] Inventors: Shigeru Suzuki, Nagoya; Hirokazu Takeuchi, Aichi; Hirosumi Itoh, Nagoya; Etsuzo Nomura, Kasugai, all of Japan

[73] Assignee: Brother Kogyo Kabushiki Kaisha, Aichi, Japan

[21] Appl. No.: 467,195

[22] Filed: Jan. 18, 1990

[30] Foreign Application Priority Data

Jan. 20, 1989 [JP] Japan ..... 1-12487

[51] Int. Cl.[5] ..... D05B 27/06; D05B 27/08

[52] U.S. Cl. ..... 112/314; 112/320; 112/121.11; 112/277

[58] Field of Search ..... 112/314, 313, 306, 312, 112/315, 320, 121.11, 275, 272, 153, 277

[56] References Cited

U.S. PATENT DOCUMENTS

| | | | |
|---|---|---|---|
| 4,612,867 | 9/1986 | Rösch et al. | 112/314 |
| 4,718,365 | 1/1988 | Hauser et al. | 112/121.11 X |
| 4,757,773 | 7/1988 | Nomura et al. | 112/121.11 |
| 4,766,828 | 8/1988 | Nomura et al. | 112/314 |
| 4,777,896 | 10/1988 | Nomura | 112/314 |
| 4,867,087 | 9/1989 | Suzuki et al. | 112/314 |
| 4,898,110 | 2/1990 | Nomura et al. | 112/314 |
| 4,901,659 | 2/1990 | Nomura et al. | 112/314 |
| 4,901,660 | 2/1990 | Takeuchi et al. | 112/314 |
| 4,917,031 | 4/1990 | Itoh | 112/314 X |

*Primary Examiner*—Peter Nerbun

*Attorney, Agent, or Firm*—Oliff & Berridge

[57] ABSTRACT

A pattern matching sewing machine comprises a sewing means for sewing two superposed sheets of cloth having substantially identical patterns thereon, a feeding means for feeding the two cloth sheets into the sewing means, a detecting means for detecting a mismatch distance between the patterns on the two cloth sheets, and a transport means to transport the two cloth sheets relatively. The pattern displacement amount detected by the pattern mismatch distance amount detecting means may be reduced. A determining means is provided for determining whether pattern matching is possible or not based on the information relating to the mismatch distance obtained by the detecting means.

13 Claims, 9 Drawing Sheets

PATTERN MATCHING SEWING MACHINE

BACKGROUND OF THE INVENTION

This invention relates to a sewing machine which sews two sheets of cloths so that patterns of two cloths may match with each other.

This kind of sewing machine is known as disclosed in the U.S. Pat. No. 4612867. A first optical sensor for upper cloth and a second optical sensor for lower cloth is provided upstream of a sewing position in the cloth feeding direction, where the first and second sensors detect light intensity signals of patterns of two superposed cloths in synchronization with feeding of the cloths. The light intensity signals of specified frequency according to intervals of patterns are detected, pattern mismatch distance are calculated based on data thereof, and relative feeding amounts of the two cloths are adjusted by a step motor so that the mismatch distance may be decreased to match the patterns.

There exist, however, cloth types having patterns that cannot be matched by the above-described sewing machine since there are many various kinds of cloths, patterns, and sewing types. Whether pattern matching of the cloths is possible or not has to be determined based on an operator's experience by visual observation of a mismatch amount after sewing. As such, the determination on whether pattern matching is possible or impossible has to be made after sewing Further because it requires experience, there was a problem that the determination was difficult. Moreover, even in sewing the cloths having patterns that can be matched, it was impossible to match patterns when the two cloths are set with patterns mismatching to a great degree, when the cloths are pulled and the patterns are greatly displaced due to an operator's carelessness, or the cloths are caught by guide members and can not be fed regularly.

SUMMARY OF THE INVENTION

It is a first object of the invention to solve the above problem, providing a sewing machine able to determine whether it is possible or not to match patterns for sewing.

It is a second object to display an information on the pattern mismatch.

The pattern matching sewing machine comprises sewing means for sewing two superposed cloth sheets having the same pattern; feeding means for feeding the two cloth sheets into the sewing means; detecting means for detecting a mismatch distance between the patterns on the two cloth sheets; and determining means for making a determination, according to the information related to the mismatch distance, whether it is possible or impossible to match the patterns on the two cloth sheets.

The pattern matching sewing machine further comprises sewing means for sewing two superposed cloth sheets into the sewing means; detecting means for detecting a mismatch distance between the patterns on the two cloth sheets; and display means for displaying an information responsive to the mismatch distance.

BRIEF DESCRIPTION OF THE DRAWINGS

The invention will now be described with reference to the accompanying drawings.

FIG. 7 is an explanatory chart of smoothed data and differentiated data of upper and lower cloths.

DETAILED DESCRIPTION OF PREFERRED EMBODIMENT

Figure 1:
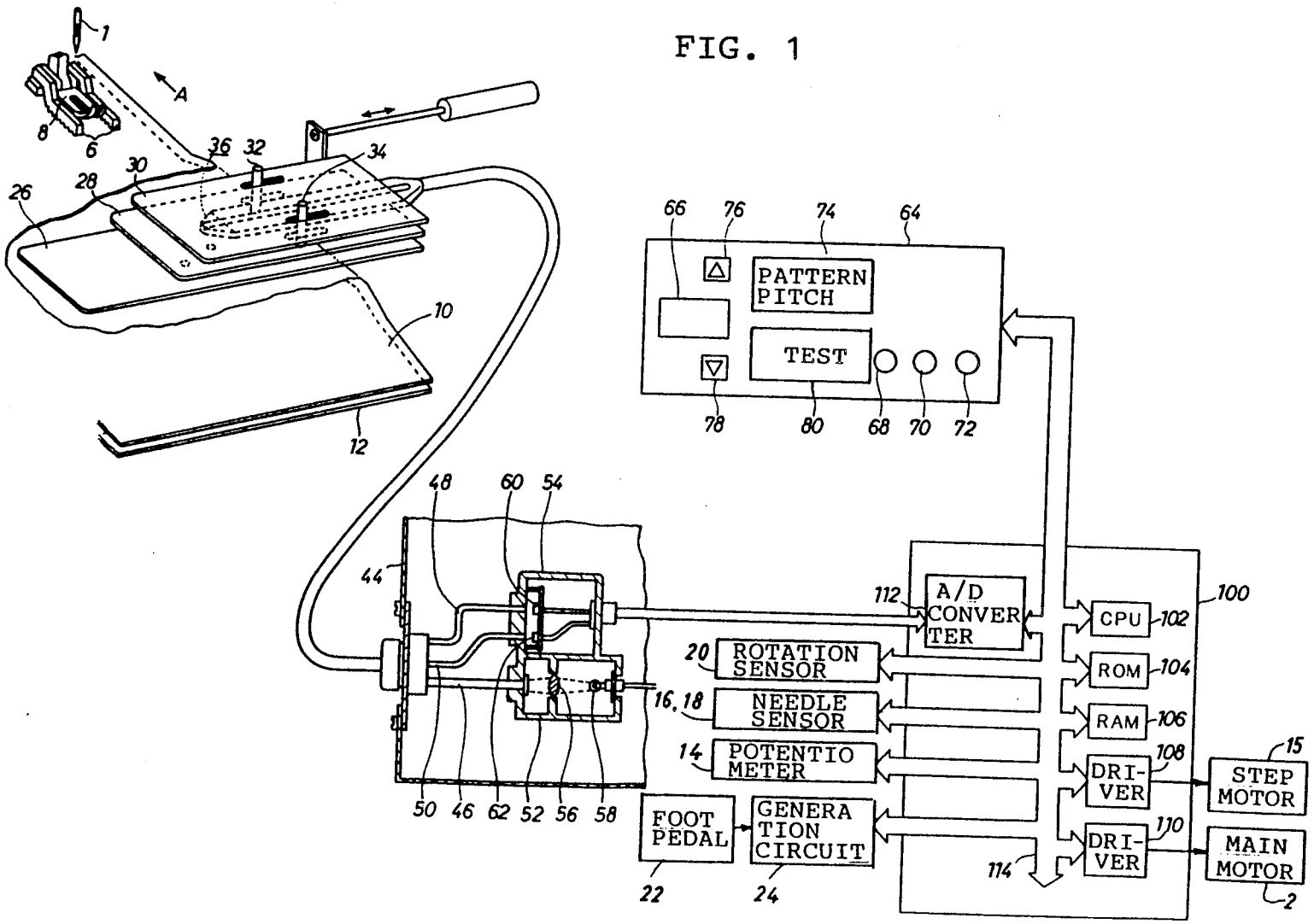
FIG. 1 is a schematic structure of the sewing machine of this invention.
Figure 2:
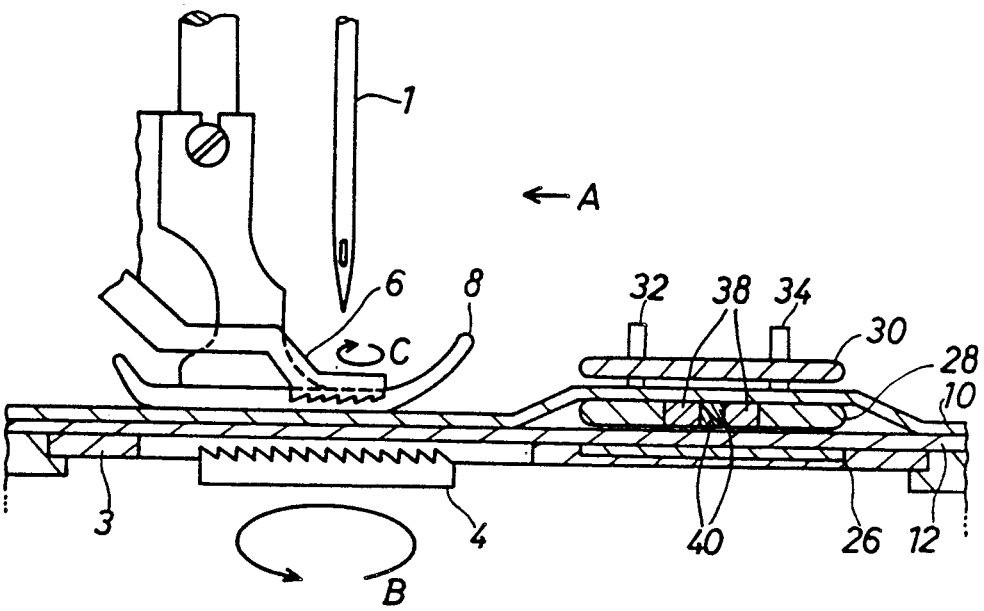
FIG. 2 is an enlarged sectional view illustrating important portions of sewing in this embodiment.

FIG. 1 is a schematic diagram of a sewing machine according to one embodiment of this invention. A sewing needle 1 is arranged for sewing to reciprocate up and down as being driven by a main motor 2 in cooperation with the well known loop taker driven by the main motor 2 which is provided under a needle plate 3. A lower feed dog 4 is also provided to make a combined vertical and horizontal movement as shown by an arrow mark B in FIG. 2 and an upper feed dog 6 is provided to make the same movement as the above as shown by an arrow mark C. The lower feed dog 4 and the upper feed dog 6 are both driven by the main motor 2. A presser foot 8 is provided to hold down two sheets of cloths 10 and 12 from the above. The above described sewing needle 1, lower feed dog 4, upper feed dog 6 and the loop taker make a synchronous movement to sew the upper and lower cloths 10 and 12 and forward them in a direction shown by an arrow mark A.

Moreover, an adjustment structure described in the U.S. Pat. No. 4777896 is provided to adjust lower feed pitch corresponding to the lower feed amount per cycle of the lower feed dog 4 in a direction as shown by the arrow mark A. The lower feed pitch of the lower feed dog 4 is detected by a potentiometer 14 operatively connected with the adjustment structure. The upper feed pitch corresponding to the upper feed amount per cycle of the upper feed dog 6 in a direction as shown by the arrow mark A is adjusted according to rotation of the step motor 15. In this structure, lower feed pitch of the lower feed dog 4 is set by the adjustment structure while upper feed pitch of the upper feed dog 6 is changed by the step motor 15, thus the feed amount of the upper cloth 10 is adjusted relative to the feed amount of the lower cloth 12.

Further, needle position detection sensors 16 and 18 are provided to output a needle-down signal and a needle-up signal of the sewing needle 1. A rotation synchronous sensor 20 is also provided to output a signal in synchronization with the rotation of a main shaft driven by the main motor 2. A generation circuit 24 is provided to generate a signal according to the pressing of a foot pedal 22. From this generation circuit 24, a start signal is generated when the front portion of the foot pedal 22 is pressed while a stop signal is generated when the foot pedal 22 is not pressed. When the rear portion of the foot pedal 22 is pressed, a thread cutting signal is generated to instruct the actuation of the well known thread cutting structure.

Three pieces of cloth guide plates 26, 28 and 30 are provided upstream of sewing position in the cloth feeding direction, stacked at specified intervals. The three guide plates 26, 28 and 30 are stacked at specified intervals to pass the upper and lower cloths 10, 12 through among them. On the lower guide plate 26, pins 32, 34 are erected to piece through long holes formed respectively on other guide plates 28 and 30. The pins 32, 34 abut the side ends of the upper and lower cloths and regulate the lateral displacement of the upper and lower cloths in the cloth feeding direction.

Figure 3:
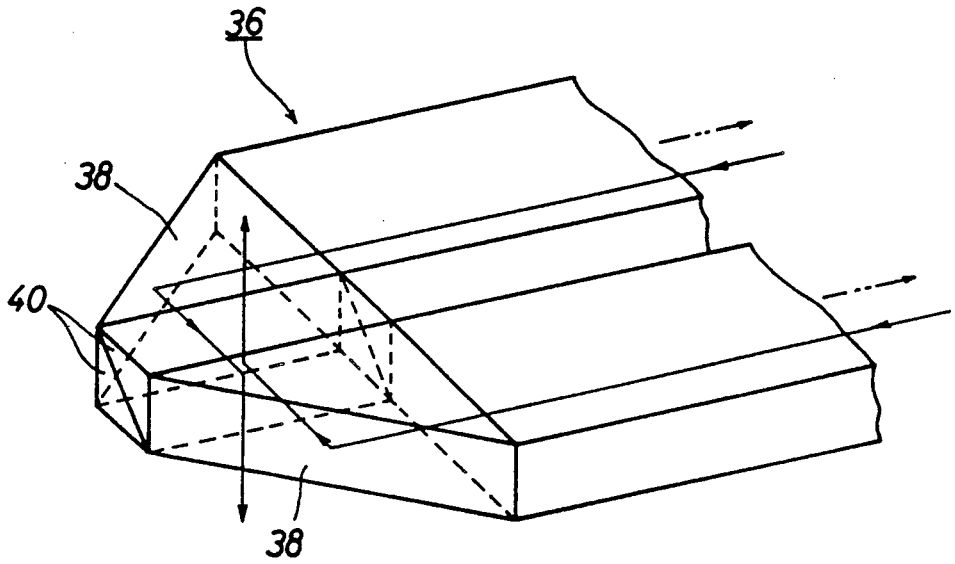
FIG. 3 is a view illustrating a structure of a tip portion of a detection member.
Figure 4:
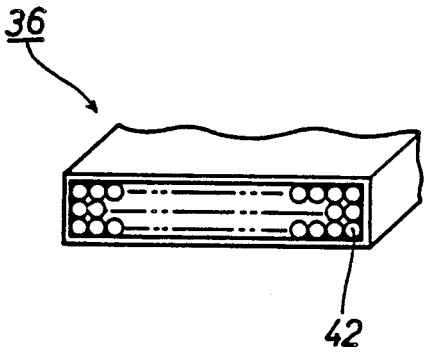
FIG. 4 is a view illustrating an internal structure of the detection member.
Figure 5A:
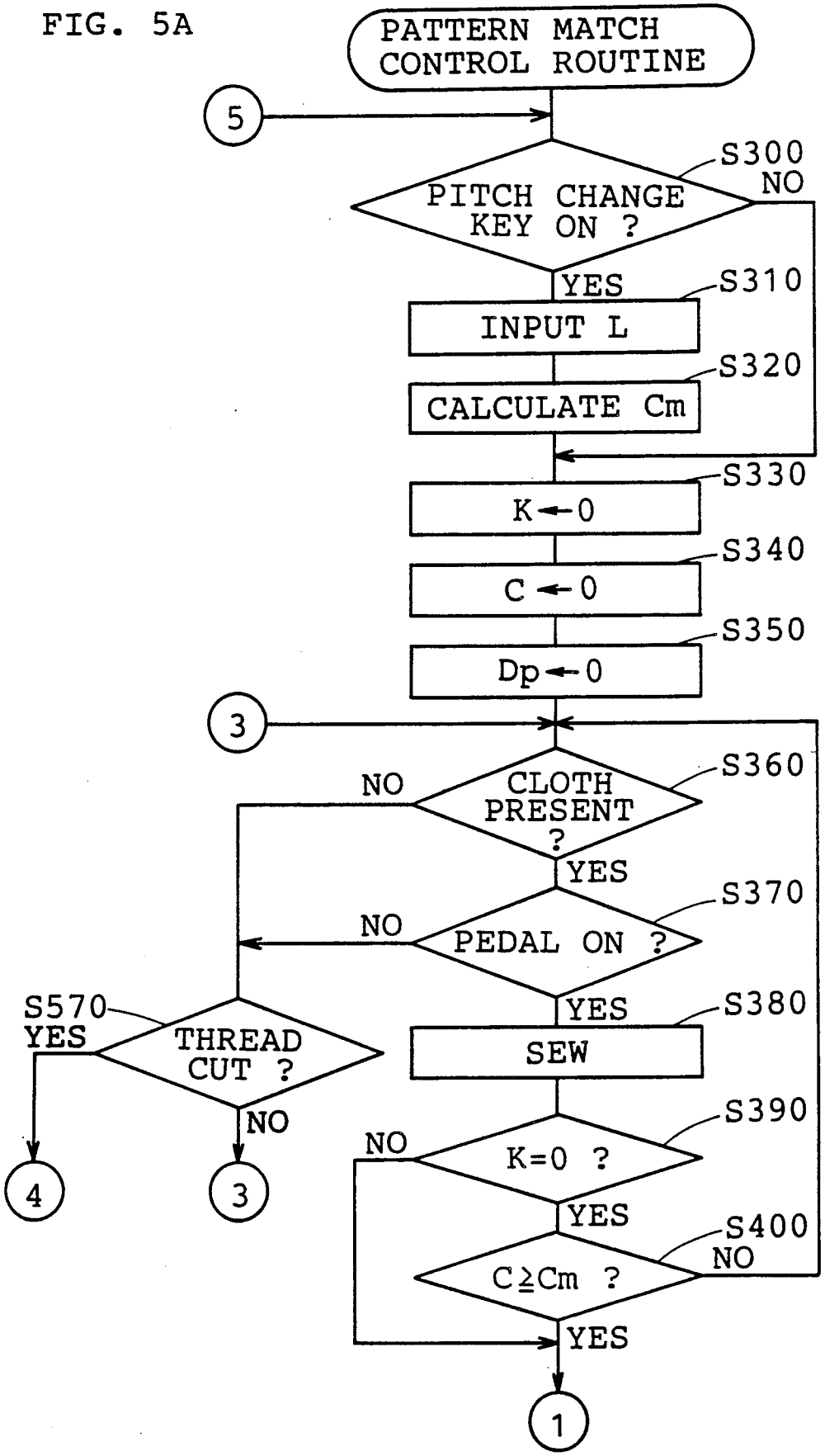
FIGS. 5 A, B, C and D are flowcharts showing pattern matching control routines in an electronic control circuit of this invention.
Figure 5B:
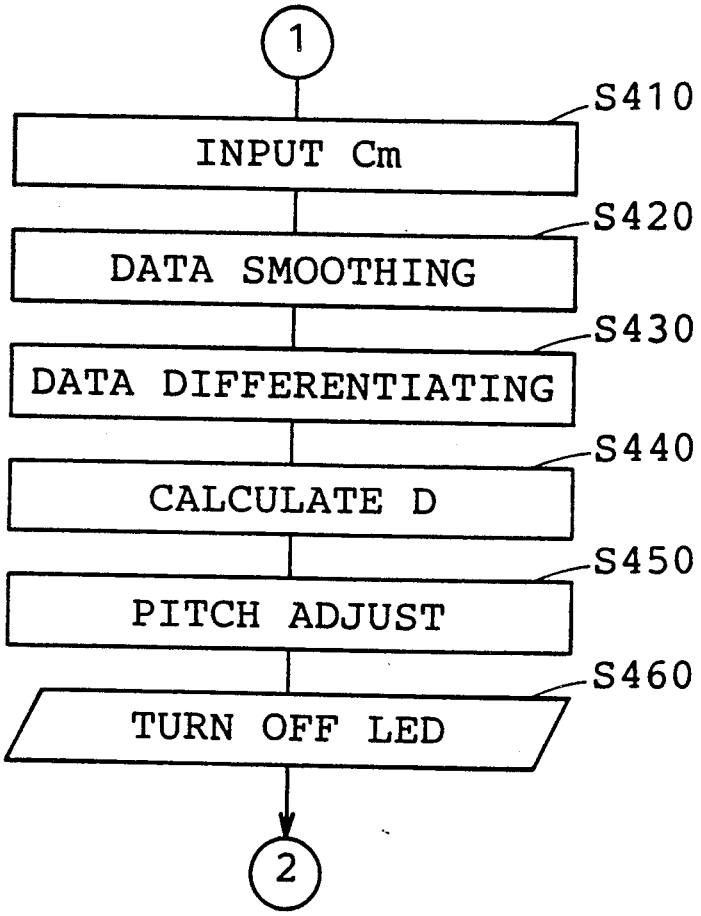
Figure 5C:
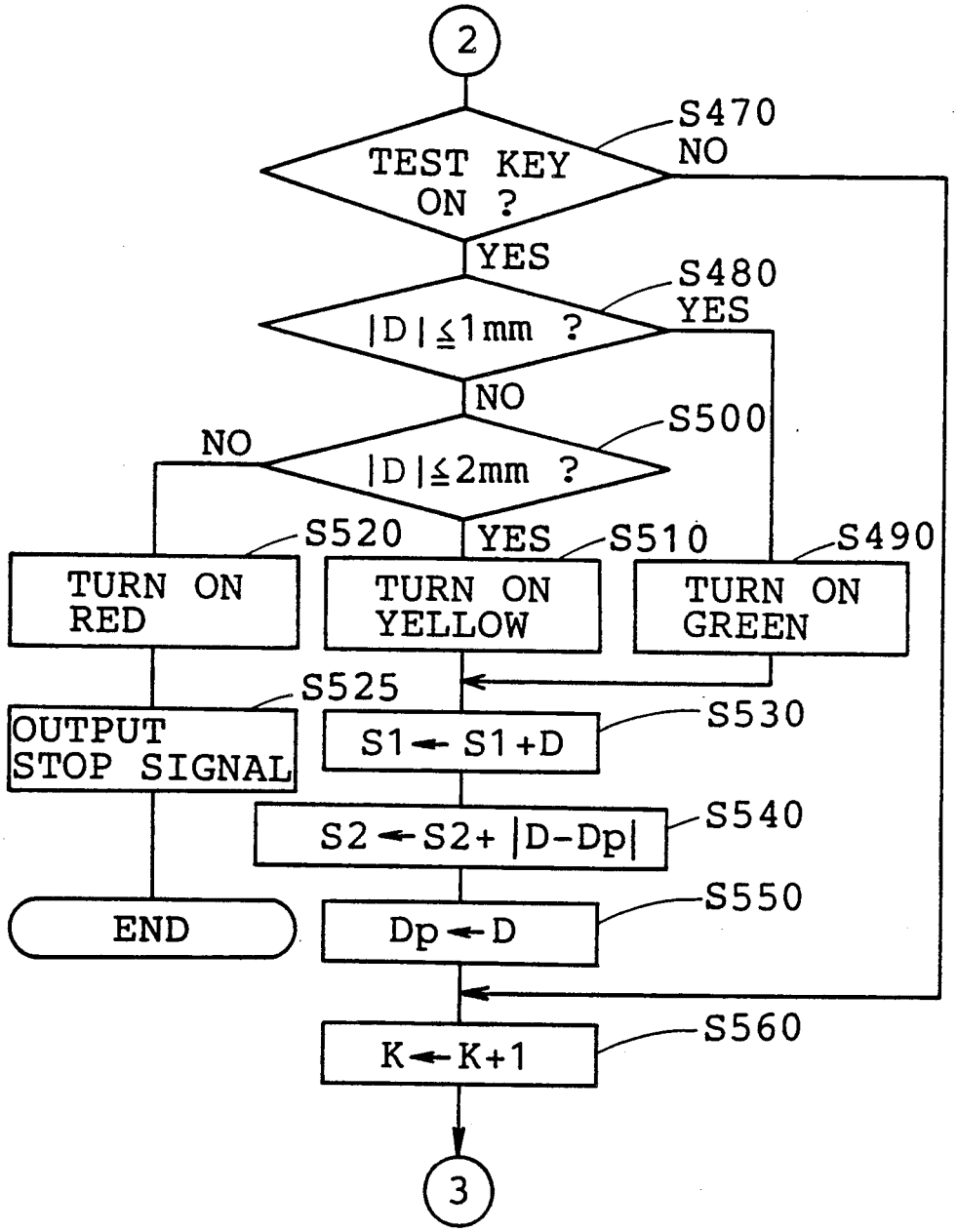
Figure 5D:
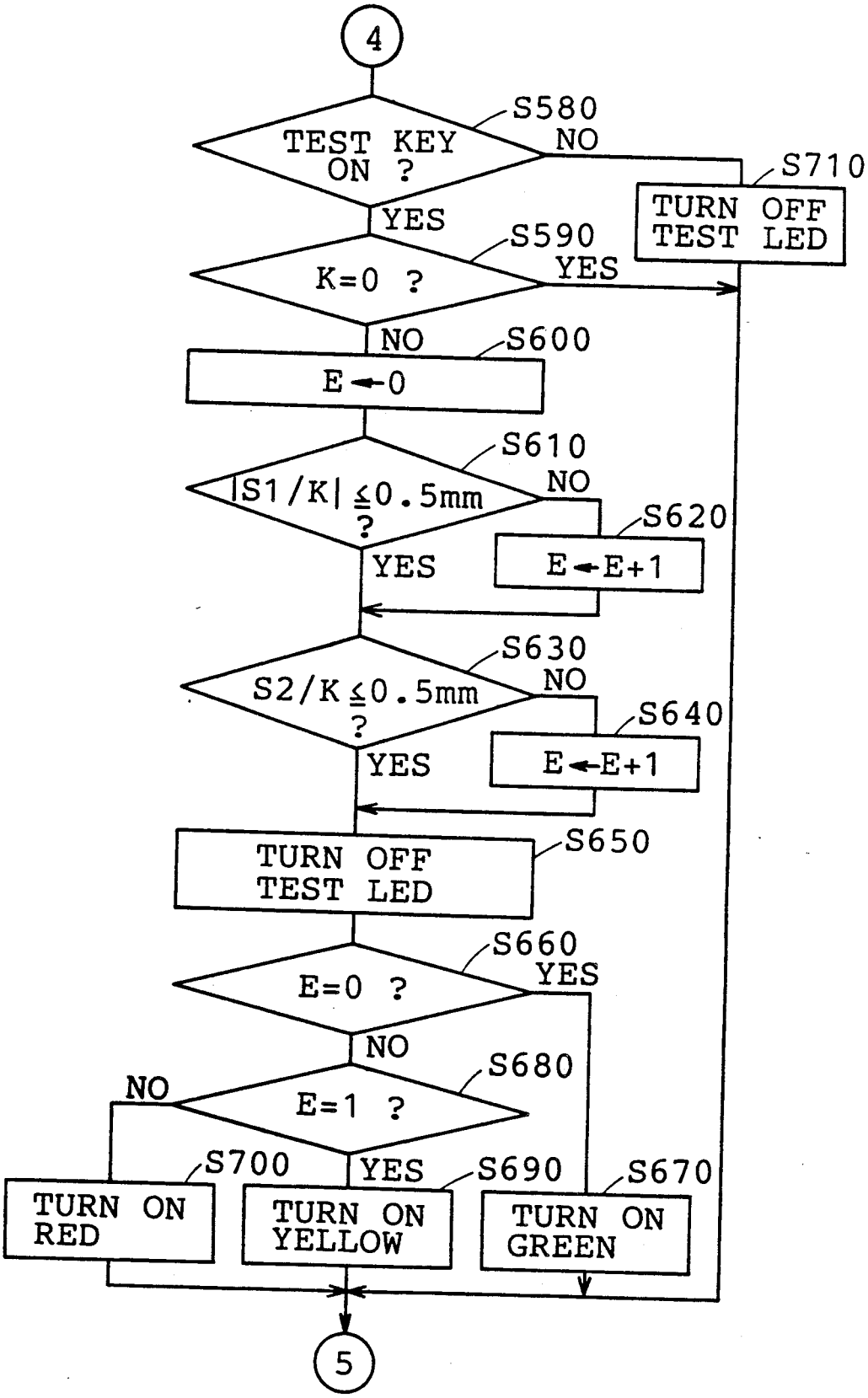

On the middle guide plate 28, the detection member 36 is embedded to detect pattern informations of the two cloths. The tip portion of the detection member 36 includes, as shown in FIG. 3, prisms 38, 40. Using the reflection of the prisms 38, 40, light is projected against the cloths 10, 12 while using the reflection of the prisms 38, 40, the light reflected on the surfaces of the cloths 10, 12 retraces the incident path. The detection member 36 incorporates, as shown in FIG. 4, a bundle of optical fibers 42 which connects with a control box 44.

The bundle of optical fibers 42 comprises a pair of light projecting fibers 46 and two pairs of light receiving fibers 48, 50 which connect with respectively a light projector 52 and a light receiver 54 in the control box 44. The light receiving fibers 48, 50 are respectively for the upper cloth 10 and the lower cloth 12. The light projector 52 includes a light source 58 to project white light on the end surface of the light projecting fiber 46 through the lens 56. The light receiver 54 includes a photo diode 60 for the upper cloth 10 and a photo diode 62 for the lower cloth 12 to receive the light from the end surfaces of the light receiving fibers 48, 50.

Accordingly, the white light projected from the light source 58 is reflected by the prisms 38, 40 disposed at the tip of the detection member 36 through the light projecting fiber 46 and projected on the cloths 10, 12. The light reflected by the cloths 10, 12 is reflected by the prisms 38, 40 and received by each photo diode 60, 62 through the light receiving fibers 48, 50. Each diode 60, 62 supplies electric signals corresponding to received intensity of light to an electronic circuit 100 provided in a control box 44.

An operational panel 64 provided on a sewing machine arm so that the operator may easily view and operate it. The operation panel 64 includes a display 66 which comprises seven segments of light emitting diodes and displays characters and numerals and also includes green, yellow and red light emitting diodes (test LED) 68, 70 and 72 Moreover, the operation panel 64 includes a pattern pitch change key 74 to instruct the change of the pattern pitch, an increment key 76 to increment numerals displayed on the display 66 when the change of pattern pitch is instructed, a decrement key 78 to decrement numerals displayed on the display 66 when the change of pattern pitch is instructed and a test key 80 to instruct start of a test for determining on whether pattern matching is possible or not.

The above described main motor 2, step motor 15, rotation synchronous sensor 20, potentiometer 14, needle position detection sensors 16, 18, generation circuit 24, photo diodes 60, 62 and operation panel 64 connect with the electronic control circuit 100. The electronic control circuit 100 comprises a CPU 102, ROM 104 for storing programs or data to be described later for control, and RAM 106 all connected through a common bus 114 with a driver 108 for the main motor 2, a driver 110 for the step motor 15, and an A/D converter 112 which converts output signals of photo diodes 60, 62 to digital signals. The CPU 102 inputs the signals from the rotation synchronous sensor 20, potentiometer 14, needle position detection sensors 16, 18, generation circuit 24, photo diodes 60, 62 and operation panel 64 and outputs drive signals to the drivers 108, 110, display 66 and light emitting diodes 68, 70, 72.

Now, the pattern matching control routine and interruption handling executed in the electronic circuit 100 will be explained with reference to the flowcharts of FIGS. 5 and 6.

Figure 6:
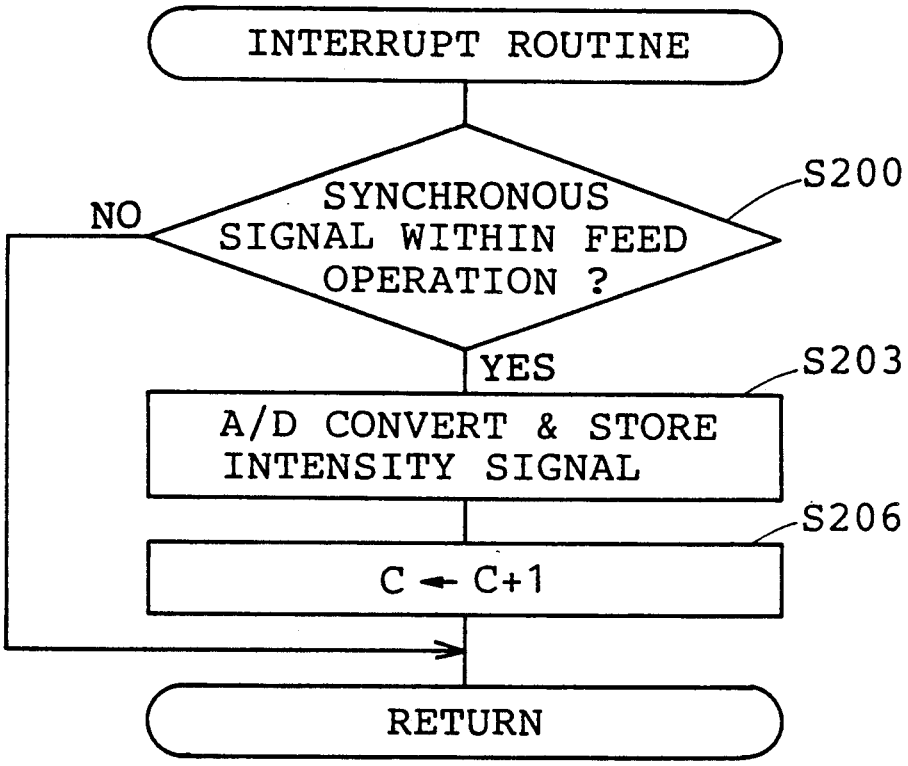
FIG. 6 is a flowchart showing an interruption handling routine.

The interruption handling routine of FIG. 6 is started at the falling edge of a synchronous signal of the rotation synchronous sensor 20. The sensor 20 outputs preset pulse signals in synchronization with the rotation of the main shaft of the sewing machine, based on which the interrupt handling routine is repeatedly executed In the interrupt handling routine, it is examined whether or not the synchronous signal from the rotation synchronous sensor 20 is within the area of the feed actuation of the upper and lower cloths 10, 12, based on the signal generated by needle position detecting sensors 16, 18. In other words, it is examined whether the sewing needle 1 goes up and the cloths 10, 12 are being forwarded by the lower feed dog 4 and the upper feed dog 6. Then it is not within the area of the feed actuation, nothing is executed. This routine is finished and goes back to the pattern matching control routine (Step 200 hereinafter referred to as S200). When the synchronous signal from the synchronous sensor 20 is within the area of the feed actuation, two light intensity signals (signals of the upper cloth 110 and the lower cloth 12) are detected by the photo diodes 60, 62. The two intensity signals are A/D converted by the A/D converter 112 and stored in RAM 106 as a pair of intensity signals data (S203). The number of intensity signals data C are incremented by one (S206), and then the step goes back to the main routine As a result, only the intensity signal data detected when the upper and lower cloths 10, 12 are being forwarded by the upper feed dog 4 and the lower feed dog 6 in the direction as shown by an arrow mark A in FIG. 1 are stored in a specified region of RAM 106.

Next, a pattern matching control routine is explained with reference to FIGS. 5A–5D. The routine is repeated in appropriate time intervals by CPU 102. The operator operates the increment key 76 or the decrement key 78, after turning on the pattern pitch change key 74 beforehand, to set a specified length L optionally. This specified length L is usually set somewhat longer than the actual length of the pattern pitch. In the pattern matching control routine, CPU 102 reads the state of the pattern pitch change key 74 (S300) and, when the pattern pitch change key 74 is not on, moves to the next step without changing the specified length L. When it is on, CPU 102 reads the specified length L set by the operator (S310) and calculates the specified number Cm (S320). This specified number Cm denotes the number of the intensity signals data from the upper and lower cloths 10, 12 corresponding to the specified length L. For example, when the specified length L is set at 30 mm, the lower feed pitch is set at 1 mm and the number of the synchronous signals within the area of feed actuation is 10 pulses, the result of calculating 10 pulses multiplied by 30 mm divided by 1 mm is 300. Subsequently, the values of the control frequency K , intensity signals data number C, and the last pattern mismatch amount Dp stored in RAM 106 are cleared (S330, S340, S350). CPU 102 waits until the two upper and lower cloths 10, 12 are set (S360), the front portion of the foot pedal 22 is pressed and the operation signal is inputted through the generation circuit 24 (S370). When the two cloths 10, 12 are set and the front of the foot pedal 22 is pressed, the main motor 2 is driven to operate the sewing machine (S380).

While operating the sewing machine, the above-described interruption handling routine is executed in synchronization with the rotation of the main shaft, and new light intensity signals are sequentially accumulated in the specified area of RAM 106. When the control frequency K set by the process described later is zero (S390) and the intensity signal data number C does not reach the specified number Cm (S400), the steps 360 through 400 are executed repeatedly and the upper and lower cloths 10, 12 are sewn in piles. Thus the intensity signal data are accumulated. When the specified number Cm is reached, the step goes to the next (S400). When only a determination of whether pattern matching of both cloths 10, 12 is possible or not is necessary, this routine may be executed without threading the needle 1. In this case, the determination can be made without sewing the upper and lower cloths 10, 12.

Next, the intensity signal data up to just before the specified number Cm are read from the up-to-date data of the both cloths 10, 12 stored in the specified region of RAM 16 (S410). The intensity signal data of 21 points before and after a point is added to the intensity signal data of that point, and the sum is divided by 43 to obtain the smoothed data for that point (S420). The smoothing process removes influences of noise. From the upper cloth 10 with the pattern shown in FIG. 7A, smoothed data shown in FIG. 7B is obtained From the lower cloth 12 with the pattern shown in FIG. 7D, smoothed data shown in FIG. 7E is obtained. The smoothed data is then differentiated (S430). The differentiating process emphasizes the acute changes and diminishes gentle changes in the smoothed data. Therefore, a gentle peak caused by the longitudinal stripes are removed as shown in FIG. 7C, F. The differentiated data of either the upper or lower cloth 10, 12 is amplified at a preset rate so that their peak heights between the upper and the lower cloths become equal. An offsetting process for each data of the cloths is then performed where an average value of all points is subtracted from each point so that the average value for each data of the cloths becomes zero. The resultant curves of the upper and lower cloths are superposed as shown in FIG. 7G. When the patterns of the upper and lower cloths 10, 12 are mismatched, for example, the upper cloth 10 is fed later than the lower cloth 12, the difference area 1 is produced as shown in FIG. 7G. The differentiated data of the upper and lower cloth 10, 12 is displaced relatively so that the difference area 1 becomes minimum to calculate the direction and the distance of the pattern mismatch of the upper and lower cloth 10, 12 (S400).

After the calculation of the mismatch amount D, the step motor 15 is driven in the direction to reduce the absolute value of the mismatch distance D so that the upper feed pitch may be adjusted (S450). Then green, yellow and red LEDs, 68, 70, 72 are turned off (S460).

Next, the state of the test key 80 is read and when it is on (S470), it is determined whether the absolute value of the mismatch distance D is less than 1 mm or not (S480). When the absolute value of the mismatch distance D is less than 1 mm, it is determined that since the distance D is small, sewing the upper and lower cloths with patterns matching is possible. Accordingly, the green LED 68 is turned on (S490). When the absolute value of the mismatch distance D is over 1 mm, it is determined whether it is less than 2 mm or not (S500). When the absolute value of the mismatch distance D is between 1 mm and 2 mm, sewing the cloths 10, 12 with patterns matching is to be done carefully, and the yellow LED 70 is turned on (S510). When the absolute value of the mismatch distance D is over 2 mm, sewing the cloths 10, 12 with patterns matching is impossible and the red LED 72 is turned on (S520). Further, a stop signal is outputted to the driver 110 to stop the main motor 2 and end at step (S525).

Thus, the status of the LEDs 68, 70, 72 displays the result of determination on whether pattern matching is possible or not, each time the control routine is repeatedly executed or at that moment of execution during sewing. For example, at the initial period of sewing the upper and lower cloths 10, 12, upper feed pitch is not fully adjusted and the absolute value of the mismatch distance D is over 1 mm. Therefore, the yellow LED 70 is turned on. As the control routine is repeatedly executed and the upper feed pitch is adjusted resulting in the absolute value of the mismatch distance amount D becoming less than 1 mm, the green LED 68 is turned on. When the cloths 10, 12 were set with patterns mismatching to a great dial and sewing started, the cloths 10, 12 were pulled during sewing due to an operator's carelessness resulting in much displacement of patterns, or the cloths 10, 12 were caught by the cloth guide plates 26, 28, 30, the absolute value of the mismatch distance amount D exceeds 2 mm. Accordingly, the red LED 72 is turned on and the sewing machine stops.

As described in the above, when the green or yellow LED 68, 70 is turned on, the mismatch distance D is added to a mismatch distance counter S1 (S530). Next, the absolute value of the mismatch distance change is added to a mismatch distance change counter S2 (S540). This change value is obtained by subtracting the mismatch distance D from the previous mismatch distance Dp. The previous mismatch distance Dp stored in RAM 106 is updated to the newest mismatch distance D (S550). Then, control frequency K is increased by one (S560) and steps subsequent to S360 are repeatedly executed. Comparing the mismatch distance D with the preset value (1, 2 mm) during the sewing, whether pattern march sewing is possible or not is determined and either of the LEDs 68, 70, 72 is turned on. This display is not limited to the three steps as in this embodiment, but may be multiple steps by dividing the preset value of 1, 2 mm into shorter increments or may be analogously displayed steplessly.

When the sewing of the cloths 10, 12 is finished and there are no cloths (S60) or the stop signal is outputted by releasing the pressing of the foot pedal 22 (S370), the rear portion of the foot pedal 22 is pressed and whether the thread cutting signal is outputted or not is determined on (S570). When the thread cutting signal is outputted, the thread cutting structure is operated and the following steps are executed determining the sewing of the cloths 10, 12 having been finished Reading the state of the test key 80, when it is on (S580), it is determined whether the control frequency K is zero or not (S590). When the control frequency K is not zero, a pattern match determining flag E is cleared (S600). Next, whether or not the average value of the mismatch distance D is less than 0.5 mm. This preset value 0.5 mm is determined by experiment and other means. The average value of the mismatch distance D is an absolute value of the mismatch distance counter S1 obtained at the process of S530 divided by the control frequency K. Even though this routine is repeatedly executed and the upper feed pitch is adjusted, the average value of the mismatch distance D becomes big, if the mismatch distance is in the same direction. When this average value is over 0.5 mm, it is determined to be hard to match patterns and the pattern match determining flag E is increased by one (S620).

On the other hand, when the average value of the mismatch distance D is less than 0.5 mm or the process at S620 is performed, it is determined whether the average value of the mismatch distance change amount is less than 0.5 mm or not (S630). This preset value 0.5 mm is determined by the experiment and other methods. This average of the mismatch distance change amount is the value of dividing the mismatch distance change counter S2 obtained at S540 by the control frequency K. Even though this control routine is repeatedly executed and the upper feed pitch is adjusted, the mismatch distance change amount becomes big, when the mismatch direction is changed each adjustment and the mismatch distance D1 does not become small.

When the average value of this mismatch distance change amount is over 0.5 mm, it is determined to be hard to match patterns and the pattern match determining flag E is increased by one (S640). Namely when the average of the mismatch distance D is less than 0.5 mm and the average value of the mismatch distance change amount is less than 0.5 mm, the pattern match determining flag E is zero. When either one of the average value of the mismatch distance D or the mismatch distance change amount is over 0.5 mm, the pattern match determining flag E is one. When both of them are over 0.5 mm, the pattern match determining flag E is two.

When the value of the flag E is set in this way, the green, yellow and red LEDs, 68, 70, 72 are all turned off (S650). When the flag E is zero (S660), sewing the upper and lower cloths 10, 12 with patterns matching is determined to be possible and the green LED 68 is turned on (S670). When the flag E is one (S660, S680), sewing both cloths 10, 12 with patterns matching must be careful and the yellow LED 70 is turned on (S690). When the flag E is two (S660, S680), sewing the cloths with patterns matching is determined to be impossible and the red LED 72 is turned on (S700). When either one of the LEDs 68, 70, 72 is turned on, the above-described processes are performed again from the S300.

In this embodiment, the display of either one of the LEDs, 68, 70, 72 based on the determination at S480, S500 is turned off after sewing, but instead of turning off, another diode may be provided to display at S670, 690, 700. When the test key 80 is determined to be off at S580, all of the LEDs, 68, 70, 72 are turned off and then the processes after S300 are repeated.

As described in the above, the pattern match sewing machine in this embodiment determines whether pattern match is possible or not at each moment of the repeated execution of this control routine by comparing the mismatch distance D with the preset value (1, 2 mm) to turn on either one of LEDs 68, 70, 72, thus enabling monitoring the state of the mismatch distance all the time in sewing. When the pattern mismatch distance amount D is over 2 mm, the sewing machine automatically stops and therefore, there is no excess sewing when patterns are displaced a great deal.

Then, thread cutting is performed. After sewing, the average values of the mismatch distance D and the mismatch distance change amount are compared with the preset value 0.5 mm to determine and display the possibility of pattern matching. By determining through the average values of the mismatch distance D and the mismatch distance change amount, the overall determination on the pattern matching of the cloths 10, 12 can be made after sewing, instead of the momentary determination of the pattern matching based on the mismatch distance D.

In this embodiment, the execution of the processes S470 through 520 determines the possibility of pattern matching momentarily on the basis of the mismatch distance D. The execution of the processes S530 through S700 determines the overall possibility of pattern matching on the basis of the average value of the mismatch distance D and the average value of the mismatch distance change amount. If necessary, only the momentary determination on the possibility of the pattern matching on the basis of the mismatch distance D can be made. Only the overall determination on the possibility of the pattern match can be made on the basis of the average value of the mismatch distance D as well as and the average value of the mismatch distance change amount.

Instead of the above-described mismatch distance D, the upper feed pitch adjusted upon the mismatch distance D may be used for determination on the momentary possibility of pattern matching or its average and the average of the upper feed change amount may be used for determination on overall possibility of pattern matching. Alternatively, it may be made on the basis of the area 1 not overlapped as shown in FIG. 7G. For example, the area value Smin which non-overlapped area 1 becomes minimum, the difference value Smax-Smin between the area value Smax which non-overlapped area 1 becomes maximum and the area value Smin which becomes minimum or the standardization value thereof (Smax−Smin)/(Smax+Smin).

This invention is not limited to the details of above embodiment and various changes and modifications are possible without departing from the spirit and scope of the invention.

What is claimed is:

1. A pattern matching sewing machine comprising;
sewing means for sewing two superposed cloth sheets, the sheets each having substantially identical patterns thereon;
feeding means for feeding the two cloth sheets into the sewing means;
detecting means for detecting a mismatch distance between the patterns on the two cloth sheets; and
determining means for making a determination, according to the information related to the mismatch distance, whether it is possible or impossible to match the patterns on the two cloth sheets.

2. A pattern matching sewing machine of claim 1 further comprising:
moving means for moving the two cloth sheets relatively to reduce the mismatch distance 3. A pattern matching sewing machine of claim 1 further comprising;
feed control means for controlling the feeding means to reduce the mismatch distance by changing relative feeding speed of the two cloth sheets 4. A pattern matching sewing machine of claim 1 further comprising;
display means for displaying the determination of the determining means when the determining means makes determination that it is impossible to match the patterns on the two cloth sheets.

5. A pattern matching sewing machine of claim 1 further comprising;

control means for stopping the sewing of the two cloth sheets when the determining means makes the determination that it is impossible to match the patterns on the two cloth sheets.

6. A pattern matching sewing machine of claim 1, wherein the determining means makes the determination, according to the mismatch distance, that it is possible to match the patterns on the two cloth sheets, each time the detecting means detects the mismatch distance during sewing.

7. A pattern matching sewing machine of claim 1, wherein the determining means makes the determination, according to the average value of the mismatch distance and the average value of the change of the mismatch distance, that it is possible to match the patterns on the two cloth sheets after sewing.

8. A pattern matching sewing matching comprising:

sewing means for sewing two superposed cloth sheets, the sheets each having substantially identical patterns thereon;

feeding means for feeding the two cloth sheets into the sewing means;

first detecting means for detecting the pattern of the upper cloth sheet;

second detecting means for detecting the pattern of the lower cloth sheet;

calculating means for calculating a mismatch distance between the patterns of the two cloth sheets based on the detection of the first and second detecting means; and display means for displaying information corresponding tot he mismatch distance calculated by the calculating means.

9. A pattern matching sewing machine of claim 8 further comprising;

moving means for moving the two cloth sheets relatively to reduce the mismatch distance.

10. A pattern matching sewing machine of claim 8 further comprising;

feed control means for controlling the feeding means to reduce the mismatch distance by changing relative feeding speed between the two cloth sheets.

11. A pattern matching sewing machine of claim 8, wherein the display means displays the information corresponding to the mismatch distance, each time the calculating means calculates the mismatch distance during sewing

12. A pattern matching sewing machine of claim 4, wherein the display means displays a first color when the determining means makes the determination that the patterns on the two cloth sheets are matched and displays a second color when the determining means determines that it is impossible to match the patterns on the two cloth sheets.

13. A pattern matching sewing machine of claim 1, wherein the display means displays a first color when the determining means makes the determination that the patterns on the two cloth sheets are matched, displays a second color when the determining means makes the determination that it is impossible to match the patterns on the two cloth sheets, and displays a third color when the determining means makes the determination that it is possible to match the patterns on the two cloth sheets.

* * * * *

UNITED STATES PATENT AND TRADEMARK OFFICE

CERTIFICATE OF CORRECTION

PATENT NO. : 5,001,998

DATED : March 26, 1991

INVENTOR(S) : Shigeru Suzuki; Hirokazu Takeuchi; Hirosumi Itoh; Etsuzo Nomura

Figure 10:
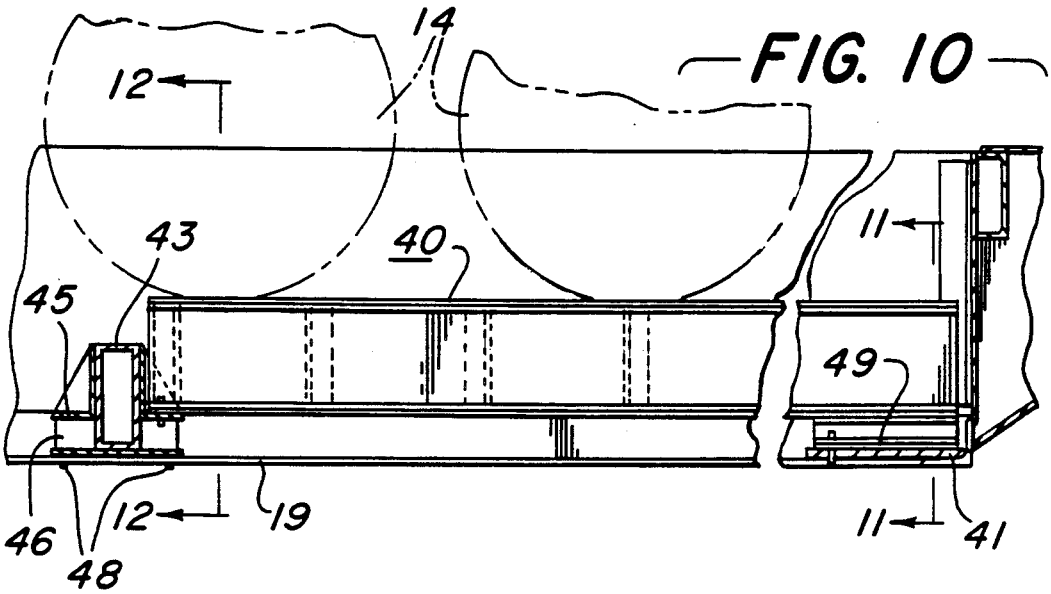
Figure 11:
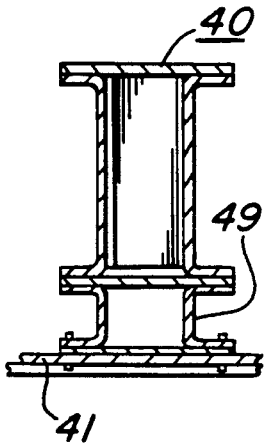
Figure 12:
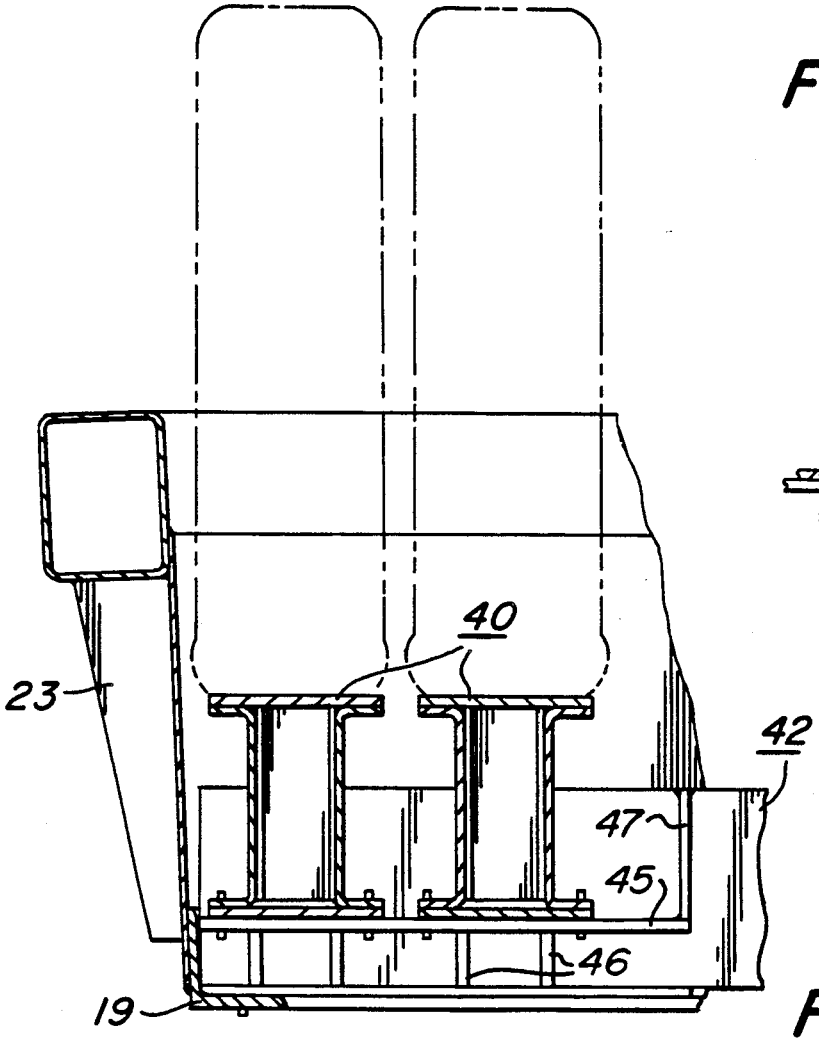

It is certified that error appears in the above-identified patent and that said Letters Patent is hereby corrected as shown below:

In the Drawings:
Insert Figures 7A-7G, and delete Figures 10, 11 and 12.

Signed and Sealed this

Sixth Day of October, 1992

*Attest:*

DOUGLAS B. COMER

*Attesting Officer*

*Acting Commissioner of Patents and Trademarks*